US006027231A

United States Patent [19]

Fouke

[11] Patent Number: 6,027,231

[45] Date of Patent: Feb. 22, 2000

[54] LUMINAIRE ASSEMBLY

[75] Inventor: Herbert Alan Fouke, Newark, Ohio

[73] Assignee: Holophane Corporation, Newark, Ohio

[21] Appl. No.: 08/998,310

[22] Filed: Dec. 24, 1997

[51] Int. Cl.[7] ..... F21V 5/02; F21V 13/04

[52] U.S. Cl. ..... 362/309; 362/328; 362/329; 362/334; 362/340

[58] Field of Search ..... 362/308, 309, 362/327–329, 332, 333, 334, 336, 337, 339, 340, 354, 360

[56] References Cited

U.S. PATENT DOCUMENTS

| | | | |
|---|---|---|---|
| 736,535 | 8/1903 | Mygatt | 362/340 |
| 1,259,493 | 3/1918 | Dorey | 362/309 |
| 1,699,100 | 1/1929 | Dorey | 362/360 |
| 2,133,378 | 10/1938 | Cullman | 362/309 |
| 3,395,273 | 7/1968 | Welty | 362/334 |
| 4,858,091 | 8/1989 | Fouke . | |
| 4,969,074 | 11/1990 | Davis et al. | 362/327 |

OTHER PUBLICATIONS

Holophane Lighting Catalog, 1953, p. 54.

*Primary Examiner*—Alan Cariaso
*Attorney, Agent, or Firm*—Brooks & Kushman P.C.

[57] ABSTRACT

An improved luminaire assembly having an HID lighting source with an upper reflector portion and a lower refractor portion. This luminaire assembly provides downlight control and glare control properties for a concentrated, narrowly spaced downwardly directed illumination. The downward light control below horizontal to uniformly distribute downward directing the light rays below horizontal to angle in the range between 30° to 50° vertical.

11 Claims, 3 Drawing Sheets

LUMINAIRE ASSEMBLY

TECHNICAL FIELD

This invention relates to an improved luminaire assembly with downlight control and glare control properties.

BACKGROUND ART

Luminaires using high intensity discharge (HID) light sources are commonly employed for commercial applications in retail and light industrial environments. The light provided by such luminaires is often accompanied by a level of glare which may be unacceptable to persons operating and functioning in these environments. Further, these luminaires may often provide more broadly distributed, upward directed light than is necessary or practical for certain commercial or work area applications.

The prior art has attempted to resolve the glare control issue for luminaires with HID lighting sources. One such reference is U.S. Pat. No. 4,858,091 (the '091 patent) issued to Herbert A. Fouke, who is also the inventor of the present invention. However, the '091 patent discloses an HID refractor luminaire which provides glare control in association with uptight control. Further, as shown in the candlepower distribution chart of FIG. 3 of the '091 patent, the luminaire of the reference also has a relatively broad light distribution, meaning it sends a greater deal of light above horizontal. Thus, there is less efficient use of luminaire to achieve a desired higher level of illumination. Accordingly, luminaires are spaced farther apart so there is no overlap.

Consequently, there is a need for an improved HID luminaire having relatively less uptight (less light above horizontal), higher levels of horizontal footcandle illumination, a more narrow (concentrated) light distribution, and further having improved glare control properties.

BRIEF SUMMARY OF THE INVENTION

It is an object according to the present invention to provide an improved luminaire which has relatively less uptight and a more concentrated light distribution downward.

It is a further object according to the present invention to provide an improved luminaire which has relatively lower glare properties.

It is still further an object according to the present invention to provide an improved luminaire which has higher levels of horizontal footcandle illumination.

And it is yet another object according to the present invention to provide an improved luminaire which allows for more efficient spacing and use for the luminaire.

The present invention utilizes an upper reflector and a bottom refractor to concentrate the light in a narrower distribution with downward focus than that disclosed in the prior art. It is lower in brightness than the type of luminaires previously used for the similar applications, namely prismatic reflectors. It also provides for improved glare control.

In carrying out the above object, features and advantages according to the present invention, provided is a luminaire having an HID light source for generating light rays. The luminaire further includes a reflector portion having a sidewall with prisms formed on the sidewall outer surface for reflecting the light rays downward from horizontal. The luminaire also includes a refractor portion having an upper sidewall refractor portion, a lower sidewall refractor portion, and an inner surface. The upper sidewall refractor portion includes an outer surface with preferably circular prisms disposed thereon for directing the corresponding light rays to one of either below horizontal or above horizontal.

The lower sidewall refractor portion has a curved shape and an outer surface with preferably circular prisms disposed thereon for directing the light rays below horizontal to an angle in the range between 30° to 50° vertical and preferably in the range between 32° to 48° vertical. Moreover, the inner surface has vertical prisms disposed thereon for laterally diffusing the light rays for reducing glare. In a preferred embodiment, the lower sidewall refractor portion has a concave curved shape.

In another embodiment there is provided a luminaire assembly having an HID light source for generating light rays. The luminaire assembly includes a reflector portion having a sidewall with prisms formed thereon for reflecting the light rays downward from horizontal in a narrow distribution. Also included is a refractor portion having an upper sidewall refractor portion and a lower sidewall refractor portion. The upper sidewall refractor portion includes an inner surface with vertical prisms disposed thereon for laterally diffusing the light rays. The upper sidewall also includes an outer surface with circular prisms disposed thereon for directing the laterally diffused light rays away from a predetermined glare zone.

The lower sidewall refractor portion has a curved shape and includes an inner surface with vertical prisms disposed thereon for laterally diffusing light. The lower sidewall refractor also includes an outer surface with circular prisms disposed thereon for directing light rays below horizontal to an angle in the range between 30° to 50° vertical.

Yet in another embodiment according to the present invention, provided is a luminaire assembly which includes an HID light source for generating a plurality of light rays. Also provided is a refractor member having an upper sidewall refractor portion and a lower sidewall refractor portion. The upper sidewall refractor portion includes an outer surface with circular prisms disposed thereon for directing corresponding light rays above and below horizontal.

The lower sidewall refractor portion has a curved shape and an opening at its bottom. The lower sidewall refractor portion also has an outer surface with circular prisms disposed thereon for directing the light rays below horizontal to an angle in the range between 30° to 50° vertical. Each of the upper sidewall refractor portion and lower sidewall refractor portion has an inner surface with vertical prisms disposed thereon for laterally diffusing the light rays. Also included in the luminaire assembly is a reflector member having a sidewall with prisms formed on its outer surface for reflecting the light rays in a direction downward from horizontal and through the opening of the lower sidewall refractor portion.

The above objects and other objects, features and advantages of the present invention are readily apparent from the following detailed description of the best modes for carrying out the invention when taken in connection with the accompanying drawings wherein like reference numerals correspond to like components.

BEST MODE FOR CARRYING OUT THE INVENTION

Figure 1:
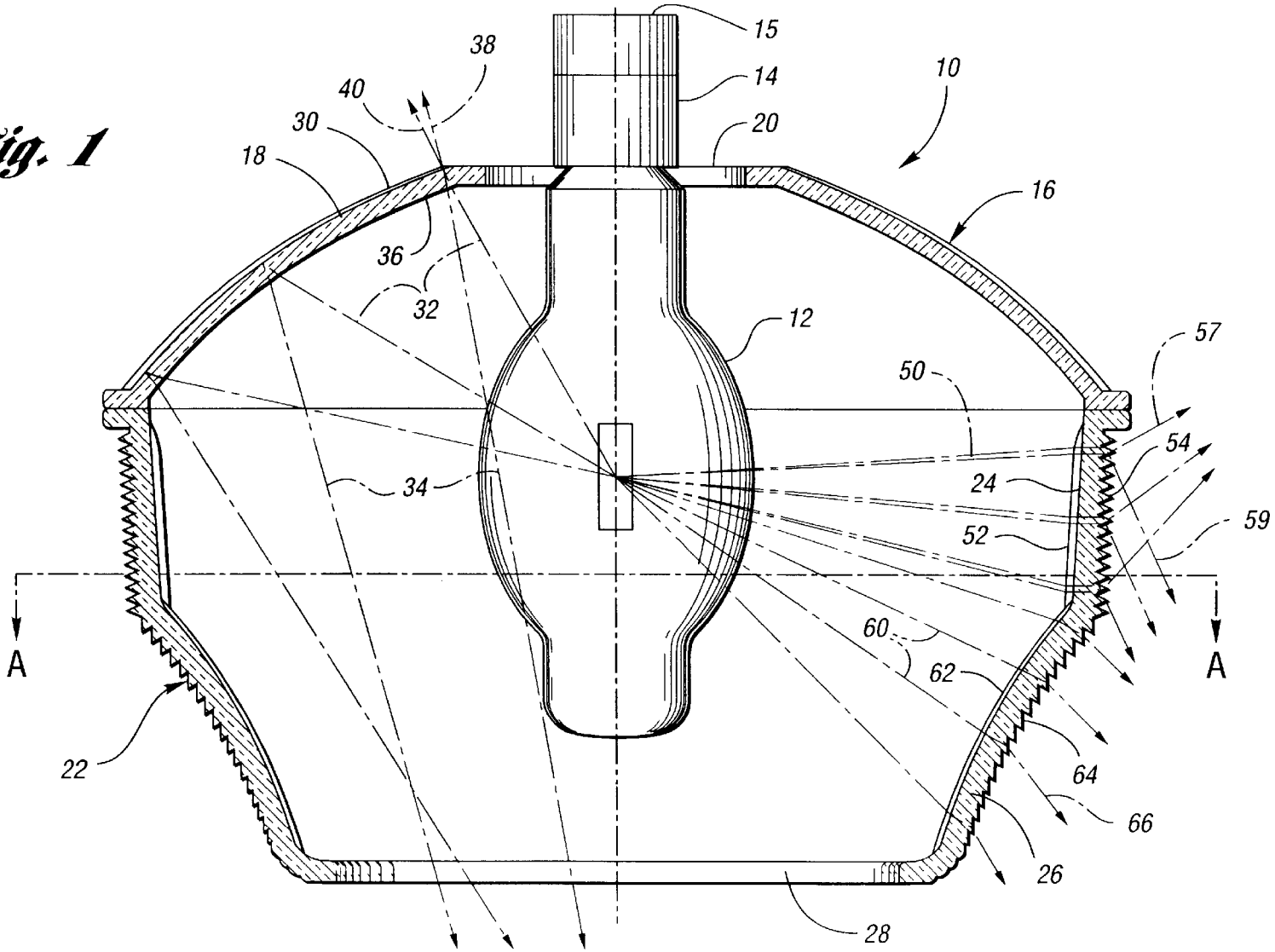
FIG. 1 illustrates a luminaire assembly in accordance with the present invention.

In accordance with the teachings of the present invention, FIG. 1 illustrates an improved luminaire assembly 10 which may also be referred to as a lighting fixture assembly. Luminaire assembly 10 has the ability to be suspended from a ceiling or otherwise be mounted in a conventional fashion to provide lighting to a corresponding work area. Luminaire assembly 10 has a high intensity discharge (HID) light source 12, which is received by and engaged in an electrical socket 14.

Luminaire assembly 10 further includes an upper prismatic reflector member 16 which is generally formed of a glass or plastic material. Upper reflector 16 has a sidewall portion 18 and a generally planar horizontal upper portion 20 which encircles socket 14. A ballast (not shown) is typically provided at the top portion of luminaire assembly 10 and disposed in area 15 to supply suitable electrical power to light source 12. As is well known in the art, HID light source 12 may be for example of the mercury, metal halide, high pressure sodium, or low pressure sodium types.

Luminaire assembly 10 further includes a lower refractor member 22 which, like upper reflector 16, is also generally formed of glass or plastic. Lower refractor 22 has a substantially vertical upper sidewall portion 24, a lower sidewall portion 26, and an opening 28. As illustrated, lower sidewall portion 26 has a concave curved shape.

Referring again to upper reflector 16 of FIG. 1, provided on the outer surface of sidewall 18 are reflecting prisms 30. Light rays 32 emitted from light source 12 strike prismatic reflector 16, and are reflected by reflecting prisms 30 as exiting reflected rays 34. Thus, ideally all of the rays 34 reflected off of reflector 16 are narrowly distributed to pass through opening 28 at the bottom of refractor 22.

Accordingly, it is provided that, ideally, reflected rays 34 neither strike nor pass through the sidewalls 24, 26 of lower refractor 22 itself, thereby achieving greater lighting efficiency. For the same reason, opening 28 provides for greater lighting efficiency than if a bottom refractor wall were to be provided in its place. According to the present invention, the lamp arc cannot be seen through the reflecting prisms when viewed from below horizontal, and thus resulting in a relatively lower average brightness. Generally, when the lamp arc can be seen through reflecting prisms, leakage light produces an area of high brightness on the reflector, as typically seen on prismatic reflector type luminaires.

In addition, a plurality of circular prisms 36 disposed on the inner surface of upper reflector 16 assist in concentrating exiting reflected rays 34 through the bottom opening 28, and also redirect any rays that leak through the peaks and valleys of reflecting prisms 30. Without circular prisms 36, these leakage rays would be emitted as leakage ray 38. With prisms 36, these leakage rays are emitted as rays 40, which allows them to be spread more evenly across the ceiling. Thus, while the focus according to the present invention is downlight, because of these leakage rays, there is also provided a relatively smaller percentage of uptight of approximately 25%.

Figure 2:
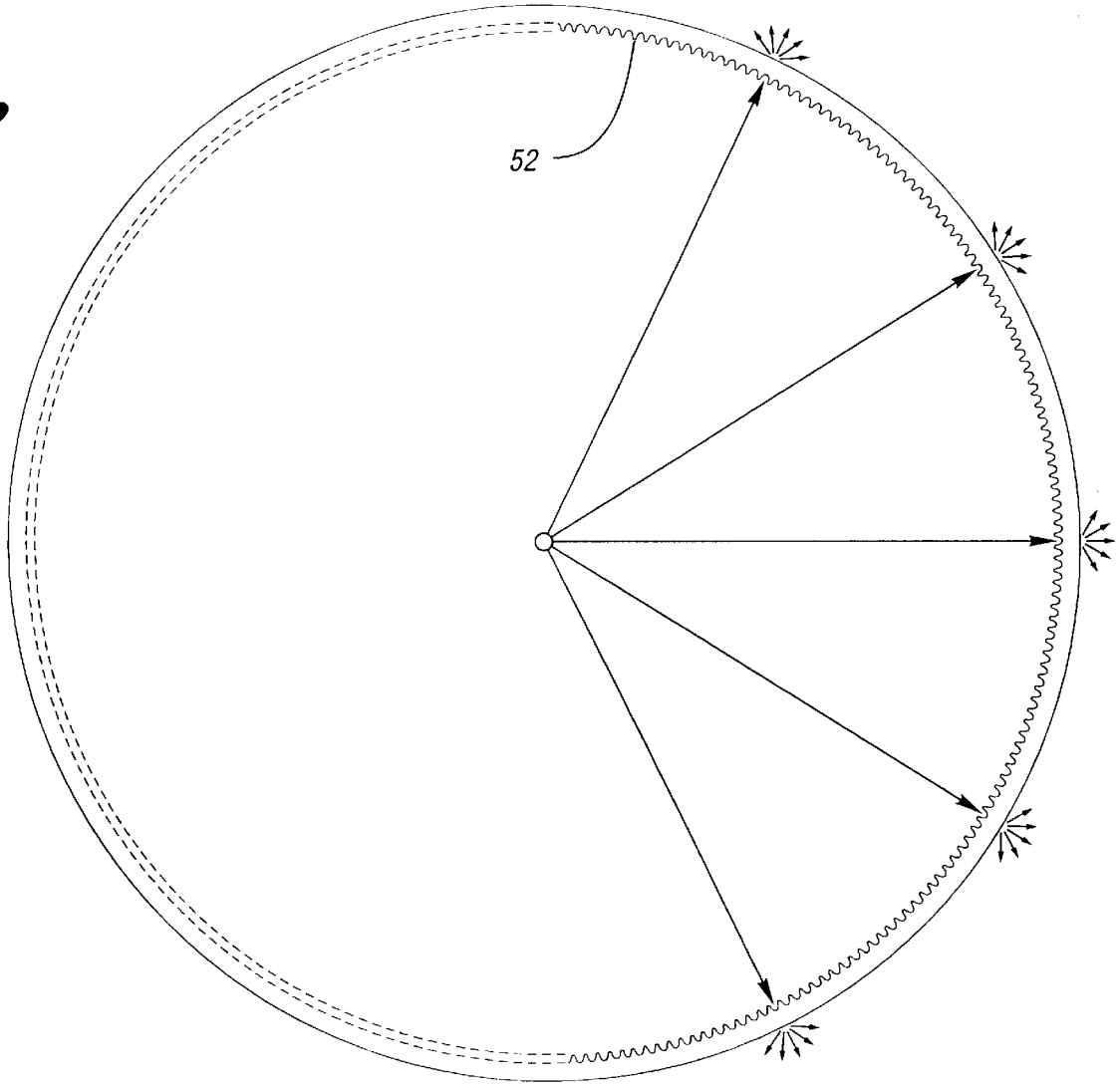
FIG. 2 is a cross-sectional view taken along the line A—A of FIG. 1.

Still Referring to FIG. 1, attention is now directed to lower refractor member 22. Particularly, it is shown therein that light rays 50 emitted from light source 12 strike upper portion 24 of lower refractor 22. Upper portion 24 of refractor 22 has inside vertical fluted diffusing prisms 52 that spread light rays 50 laterally. These fluted vertical prisms 52 are further illustrated in FIG. 2 and FIG. 3. FIG. 2 shows a cross-section through line A—A of FIG. 1, and FIG. 3 shows a magnified partial cross-section through line A—A of FIG. 1.

Figure 3:
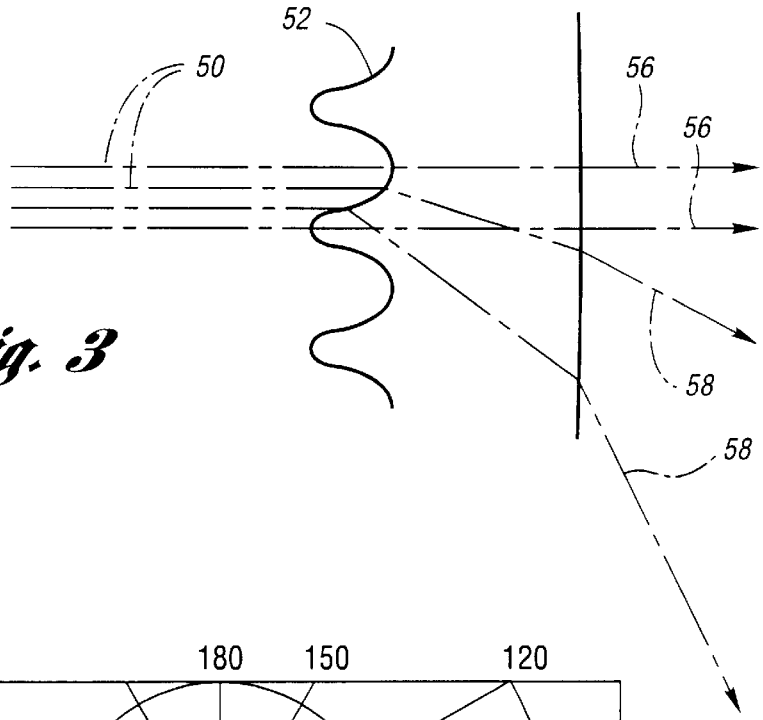
FIG. 3 is a magnified view of the diffusing prisms taken partially taken along the line A—A of FIG. 1.

As shown in FIG. 3, diffusing prisms 52 have curved surfaces such that light rays 50 are diffused laterally at varying angles to eventually be emitted as light rays 56 and 58. This lateral diffusion makes the surface of refractor 22 appear to be evenly bright, and further serves to reduce average brightness. A plurality of circular prisms 54 are located on the outer surface of upper refractor portion 24.

Subsequent to the aforementioned lateral diffusion, prisms 54, by means of internal reflection, split emitted light rays 50, sending a partial plurality of the exiting light rays 57 elevated above horizontal, and the remaining plurality of the exiting light rays 59 below horizontal. Particularly, the light rays strike the bottom surface of prisms 54, are reflected off of it (internal reflection) and are refracted up, or conversely strike the top surface of prisms 54, are reflected off of it and are refracted down to light the work area. However, as before, glare is eliminated since preferably little or no light is emitted to a predetermined glare zone, which is defined herein by the area from about 50° to 90° vertical. It is in this zone that light is a source of undesired glare. However, under normal conditions, a relatively small amount of light rays may enter the glare zone, which still effectively results in reduced glare properties.

Referring again to FIG. 1, the plurality of light rays 60 emitted from light source 12 strike the lower portion 26 of refractor 22. The inner surface of this lower portion 26 of lower refractor 22 has vertical prisms 62 similar to those prisms 52 on the inside of upper portion 24. Additionally, subsequent to the light rays being laterally diffused by prisms 62, the outer surface of lower portion 26 has circular prisms 64 that refract light rays 60 down below horizontal to an angle equal to or below a maximum of 50° vertical. More specifically, this angle is typically in the range from 30°–50° vertical and preferably in the range between 32°–48° vertical. In a most preferred embodiment, this angle would be in the range between 32°–45° vertical. Ideally, no rays are sent at angles above 50° into the aforementioned glare zone.

The curved design of the lower portion 26 of refractor 22—and particularly the concave shape of lower portion 26—allows emitted rays 60 to be redirected to aforementioned lower angles as rays 66, thus providing more refractive action. The resulting angle is lower than it would be if this lower portion 26 had the same angle and general shape as upper portion 24.

Figure 4:
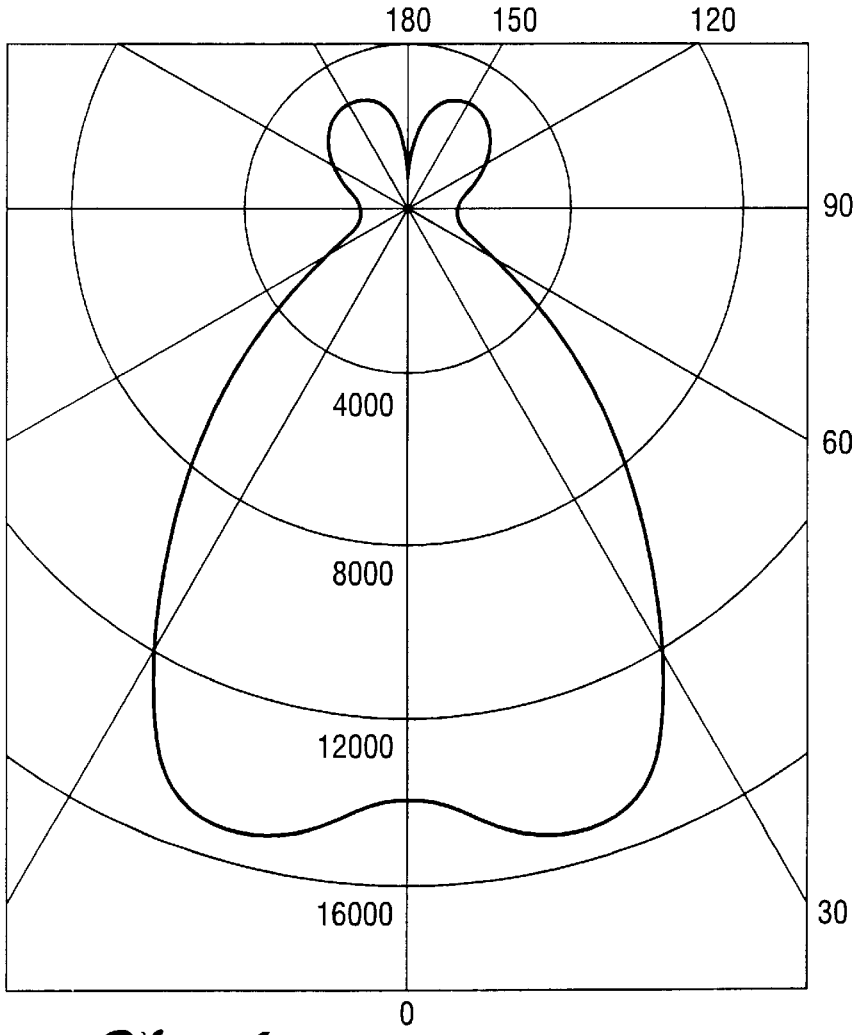
FIG. 4 illustrates a typical candlepower distribution curve for a luminaire as shown in FIG. 1.

With reference directed to FIG. 2, illustrated therein is a cross-sectional view taken through line A—A of FIG. 1. The dashed line pattern signifies that diffusing prisms 52 are carried over the entire inner surface of upper portion 24. Moreover, FIG. 3 is a larger scale view of diffusing prisms 52 through line A—A of FIG. 1. Also, as illustrated in FIG. 4, provided therein is a typical candlepower distribution curve for luminaire assembly 10 according to the present invention. As illustrated by this distribution curve, luminaire assembly 10 has approximately 75% (seventy-five percent) of the light emitted by luminaire assembly 10 in the 0°–90° zone (below horizontal) and 25% (twenty-five percent) of the light in the 90°–180° zone (above horizontal). As estimated by FIG. 4, half candle power of the luminaire shown is approximately 40°. Conversely, the half candlepower of the luminaire of previously discussed U.S. Pat. No. 4,858,091 can be understood from its FIG. 3 to be approximately 60°. Moreover, luminaire assembly 10 according to the present invention has higher levels of horizontal footcandle illumination relative to that shown, for example, in U.S. Pat. No. 4,858,091.

The candlepower distribution of luminaire assembly 10 according to the present invention allows adjacent luminaires to be spaced closer together, thus allowing for a more concentrated, narrow downlight distribution, but so that their illumination does not overlap. Thus, the desired concentrated distribution of light is achieved by the operation of reflector 16 and refractor 22.

It is noted that according to the present invention, the lamp arc of the present invention cannot be seen through the reflecting prisms 30 when viewed from below horizontal. If the lamp arc can be seen through reflecting prisms 30 leakage light produces an area of high brightness on the reflector, as seen on all prismatic reflector type luminaires.

It is understood, of course, that while the forms of the invention herein shown and described include the best mode contemplated for carrying out the present invention, they are not intended to illustrate all possible forms thereof. It will also be understood that the words used are descriptive rather than limiting, and that various changes may be made without departing from the spirit or scope of the invention as claimed below.

What is claimed is:

1. A luminaire having a high intensity discharge light source for generating light rays, the luminaire comprising:

a refractor portion having an upper sidewall refractor portion and a lower sidewall refractor portion with an opening at its bottom, the upper sidewall refractor portion including an outer surface with prisms disposed thereon for directing the corresponding light rays to one of either below horizontal or above horizontal, the lower sidewall refractor portion having a curved shape and an outer surface with prisms disposed thereon for directing the light rays below horizontal to an angle in the range between 30° to 50° vertical, and the upper sidewall refractor portion and the lower sidewall refractor portion each having an inner surface with vertical prisms disposed thereon for laterally diffusing the light rays for reducing glare; and a reflector portion having a sidewall with prisms formed on the sidewall outer surface for reflecting the light rays downward through the opening of the lower sidewall refractor portion.

2. The luminaire of claim 1, wherein the prisms of both the upper and lower sidewall refractor portions are circular prisms.

3. The luminaire of claim 1, wherein the prisms disposed on the outer surface of the lower sidewall refractor portion direct the light rays below horizontal to an angle in the range from approximately 32° to 48° vertical.

4. The luminaire of claim 1, wherein the lower sidewall refractor portion has a concave curved shape.

5. A luminaire having a high intensity discharge light source for generating light rays, the luminaire comprising:

a reflector portion having a sidewall with prisms formed on the sidewall outer surface for reflecting the light rays downward from horizontal in a narrow distribution; and a refractor portion having an upper sidewall refractor portion and a lower sidewall refractor portion, the upper sidewall refractor portion including an inner surface with vertical prisms disposed thereon for laterally diffusing the light rays and an outer surface with prisms disposed thereon for directing the laterally diffused light rays away from a predetermined glare zone, the lower sidewall refractor portion having a curved shape and including an inner surface with vertical prisms disposed thereon for laterally diffusing light and an outer surface with prisms disposed thereon for directing light rays below horizontal to an angle in the range between 30° to 50° vertical, wherein the lower sidewall refractor portion has an opening formed therein at its bottom through which pass the light rays reflected from the reflector portion downward from horizontal.

6. The luminaire of claim 5, wherein the prisms of both the upper and lower sidewall refractor portions are circular prisms.

7. The luminaire of claim 5, wherein the prisms disposed on the outer surface of the lower sidewall refractor portion direct the light rays below horizontal to an angle in the range from approximately 32° to 48° vertical.

8. The luminaire of claim 5, wherein the lower sidewall refractor portion has a concave curved shape.

9. A luminaire assembly comprising:

a high intensity discharge light source for generating a plurality of light rays;

a refractor member having an upper sidewall refractor portion and a lower sidewall refractor portion each having an inner surface with vertical prisms disposed thereon for laterally diffusing the light rays, the upper sidewall refractor portion including an outer surface with circular prisms disposed thereon for directing a majority of the corresponding laterally diffused light rays to one of either below horizontal or above horizontal for reducing glare, the lower sidewall refractor portion having a curved shape and an opening at its bottom, and an outer surface with circular prisms disposed thereon for directing its corresponding laterally diffused light rays below horizontal to an angle in the range between approximately 30° to 50° vertical; and a reflector member having a sidewall with prisms formed on its outer surface for reflecting the light rays in a direction downward from horizontal in a narrow distribution through the opening of the lower sidewall refractor portion.

10. The luminaire assembly of claim 9, wherein the prisms disposed on the outer surface of the lower sidewall refractor portion direct the light rays below horizontal to an angle in the in the range from approximately 32° to 48° vertical.

11. The luminaire assembly of claim 9, wherein the lower sidewall refractor portion has a concave curved shape.

* * * * *